US007316054B2

(12) United States Patent
Acton et al.

(10) Patent No.: US 7,316,054 B2
(45) **Date of Patent: *Jan. 8, 2008**

(54) SEALABLE CASKET HAVING MEMORABILIA COMPARTMENT

(75) Inventors: Troy D. Acton, St. Paul, IN (US); Walter A. Hullemeyer, Batesville, IN (US); William F. Neth, Batesville, IN (US); Roger L. Reuss, Brookville, IN (US); Charles F. Winburn, Batesville, IN (US)

(73) Assignee: Batesville Services, Inc., Batesville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/140,895

(22) Filed: May 31, 2005

(65) Prior Publication Data

US 2005/0217090 A1 Oct. 6, 2005

Related U.S. Application Data

(63) Continuation of application No. 09/492,032, filed on Jan. 27, 2000, now Pat. No. 6,898,830.

(51) Int. Cl.
*A61G 17/00* (2006.01)

(52) U.S. Cl. ..... 27/2; 27/1; 27/16; 312/334.7; 312/334.44

(58) Field of Classification Search ..... 27/1, 27/2, 14, 16, 17, 19; 312/296, 330.1, 333, 312/334.7, 334.8, 334.44, 319.1, 334.1; D99/8
See application file for complete search history.

(56) References Cited

U.S. PATENT DOCUMENTS 2,533,827 A 12/1950 McEwan
2,533,828 A 12/1950 McEwan
2,937,765 A 5/1960 Shank
3,680,941 A * 8/1972 Shanks ..... 312/296
4,324,026 A * 4/1982 Craft ..... 27/1
4,697,316 A 10/1987 Semon
4,868,957 A 9/1989 Rojdev
4,962,574 A 10/1990 Estes
5,088,167 A 2/1992 Rahe
5,093,968 A 3/1992 Rojdev et al.
5,152,161 A * 10/1992 Lee ..... 70/127
5,379,499 A 1/1995 Jackson
5,611,124 A * 3/1997 Biondo et al. ..... 27/2
5,675,876 A 10/1997 Benedict et al.
5,678,289 A 10/1997 Saaf
5,704,103 A * 1/1998 Crowley et al. ..... 27/1
5,727,291 A * 3/1998 Biondo et al. ..... 27/2
6,324,736 B1 * 12/2001 Atrio ..... 27/2
6,324,737 B1 * 12/2001 Chamness et al. ..... 27/2
6,836,936 B1 * 1/2005 Biondo et al. ..... 27/2
6,976,294 B2 * 12/2005 Biondo et al. ..... 27/2
2004/0200046 A1 * 10/2004 Biondo et al. ..... 27/2

* cited by examiner

*Primary Examiner*—William L. Miller
(74) *Attorney, Agent, or Firm*—Wood, Herron & Evans, LLP

(57) ABSTRACT

A sealable casket having a memorabilia compartment comprises a shell and at least one cap pivoted to the shell. The shell and cap have respective confronting flanges. A gasket is disposed between the flanges of the shell and the cap forming a seal therebetween. A memorabilia compartment is formed within the cap and includes an access opening and an interior. A removable cover is positioned over the access opening, and a gasket is disposed between the cover and the cap forming a seal therebetween.

11 Claims, 6 Drawing Sheets

SEALABLE CASKET HAVING MEMORABILIA COMPARTMENT

RELATED APPLICATIONS

This application is a continuation of application Ser. No. 09/492,032 filed Jan. 27, 2000, now U.S. Pat. No. 6,898,830, which is hereby incorporated by reference herein.

BACKGROUND OF THE INVENTION

A casket has a lower body containing shell to which is pivoted, in the case of so-called "full top" for "full couch" caskets, a single full length lid or "cap," and in the case of so-called "split top" or "cut top" caskets, a pair of lids—a head end cap and a foot end cap. Burial caskets have traditionally been constructed of either fine furniture grade wood or highly polished sheet metal. Sheet metal caskets are fabricated from a number of preformed sheet metal panels which are joined together by welding. As such, sheet metal caskets have continuous, essentially leak-free, joints adjoining adjacent sheet metal panels. Sheet metal caskets are known in the industry as "sealable" caskets, that is, there is a sealing gasket between the shell and cap in a full top casket, and in a cut top casket between the shell and the caps and between the caps themselves. Examples of sealing gaskets for use in sealable sheet metal caskets may been seen with reference to the assignee's U.S. Pat. Nos. 5,093,968, 4,868,957, 2,533,828 and 2,533,827, the entire disclosures of which are hereby incorporated by reference herein as if fully set forth in their entirety. Sealable caskets prevent the escape of bodily fluids and gases prior to interment, and prevent rain water from entering the casket after burial. Wood caskets, on the other hand, are generally not fabricated as "sealable" in light of the fabrication techniques associated with joining the wood panels of a wood casket and since after burial a wood casket rapidly decomposes.

Memorialization has of late become quite important in the funeral industry. Attempts have been made to provide the family members with a dignified, meaningful means of memorializing the deceased and in doing so to permit the grieving family members to play a more integral role in the bereavement process. To that end, the assignee has provided, as disclosed in its U.S. Pat. Nos. 5,727,291 and 5,611,124, the entire disclosures of which are hereby incorporated by reference herein as if fully set forth in their entirety, a designated, easily accessible receptacle or compartment forming a part of the casket for either the placement of personal effects of the deceased therein or the inclusion therein of mementos of memorialization by the deceased's family and friends.

It would be desirable to further advance the invention of U.S. Pat. Nos. 5,727,291 and 5,611,124 by specifically adapting it to the construction of sealable caskets.

SUMMARY OF THE INVENTION

To that end the present invention is a sealable casket having a memorabilia compartment. The casket comprises a shell and at least one cap pivoted to the shell. The shell and cap have respective confronting flanges. A gasket is disposed between the flanges of the shell and the cap forming a seal therebetween. A memorabilia compartment is formed within the cap and includes an access opening and an interior. A removable cover is positioned over the access opening, and a gasket is disposed between the cover and the cap forming a seal therebetween.

The casket may be a full top casket having a single full length cap, or a cut top casket having a head end cap and a foot end cap. The cover plate is preferably a face plate of a drawer movably mounted in the cap. In the case of cut top caskets, the drawer may be movably mounted in either of the head end and foot end caps, and preferably is movably mounted in the foot end cap. Likewise in the case of cut top caskets, the casket further comprises a gasket disposed between the head and foot end caps forming a seal therebetween.

In a preferable form of the invention wherein the drawer is movably mounted in the foot end cap, the foot end cap includes a header wall and the access opening is formed in the header wall. The drawer is movable into and out of the foot end cap through the access opening in the header wall. The gasket is positioned against an outside surface of the header wall and around the access opening. A drawer support is mounted within the foot end cap and from an inside surface of the header wall. The drawer support preferably is an open ended generally C-shaped channel. The channel is mounted from the inside surface of the header wall with a pair of brackets, one bracket of the pair being located on each lateral side of the channel. Each bracket preferably has a longer leg and a shorter leg. The longer leg is secured to the channel and the shorter leg is secured to the inside surface of the header wall. Each bracket is preferably generally C-shaped so as to be reversible side- to-side relative to the channel and end-to-end relative to the bracket. The longer leg has an upwardly directed U-shaped tang at a lower edge thereof. A free end of this tang is received in a slot at a lower edge of the channel. A downwardly directed U-shaped clip has one leg received in a slot at an upper edge of the channel. The other leg of the U-shaped clip retains the longer leg of the bracket against a side of the channel.

The drawer is preferably spring biased towards an outward position. To that end, each lateral side of the channel includes a semicircular channel therein, and each semicircular channel includes a compression spring therein retained at an inward end thereof by a retaining pin. The drawer includes a rail on each lateral side which rides in a respective semicircular channel. Pushing the drawer completely into the channel causes the rails of the drawer to compress the compression springs.

The casket further includes a latch mechanism which latches the drawer in an inward position and compresses the gasket between the face plate of the drawer and the header wall. To that end the latch mechanism preferably includes a cam operable on an inside surface of the header wall which when actuated draws the face plate and header wall toward one another. The cam is preferably actuated by a rotatable element mounted in the face plate of the drawer which when rotated rotates the cam to and between an engaged position whereby the drawer is locked in the cap and a disengaged position whereby the drawer may be withdrawn from the cap. A rubber washer is disposed between the rotatable element and a face plate forming a seal therebetween. The rotatable element is preferably a hex head insert housed within a housing which itself is mounted in the face plate. The housing preferably has a flange on one end and is threaded on the other end. A rubber washer is compressed between the flange and face plate by a nut threaded onto the housing threaded end on an inside surface of the face plate. The hex head insert is threaded and the cam is secured onto the insert threaded end by a nut, the cam and cam nut being positioned inward of the housing nut.

The casket further includes at least one drawer stop operable between the channel and the drawer to prevent the drawer from being completely withdrawn from the channel.

In a preferred form, the drawer stop comprises a U-shaped first end which fits over a front upper edge of the channel and a wing extending generally perpendicularly from the U-shaped first end. The wing projects through a slot in an upper portion of the channel such that the wing is in the path of a rear wall of the drawer as the drawer is withdrawn from the channel thereby blocking complete withdrawal of the drawer from the channel.

These and other advantages of the present invention will become more readily apparent during the following detailed description taken in conjunction with the drawings herein, in which:

DETAILED DESCRIPTION OF THE INVENTION

Figure 1:
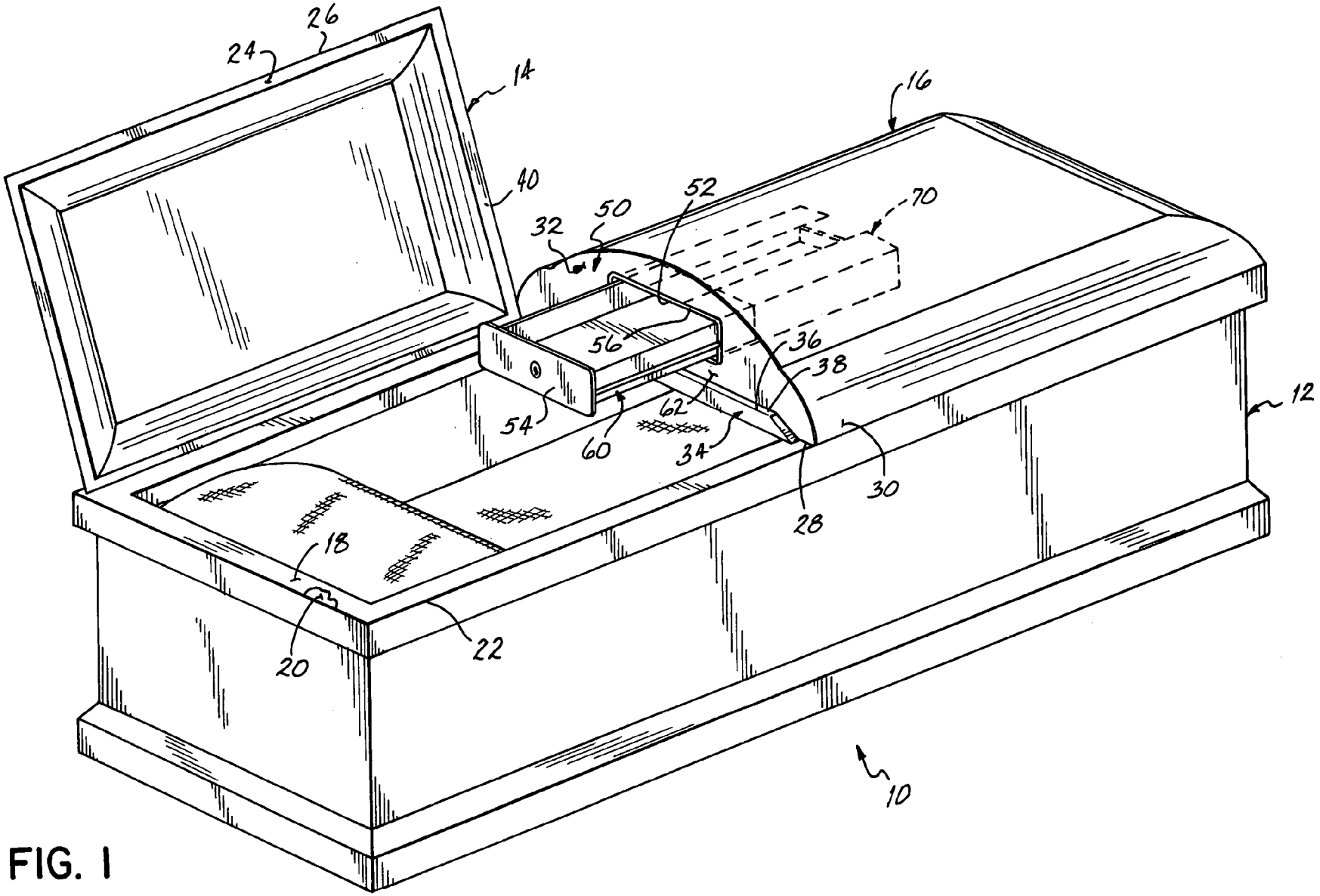
FIG. 1 is a perspective view of the invention.

Referring first to FIG. 1, there is illustrated a casket 10 according to the principles of the present invention. The casket 10 includes a lower body containing shell 12 to which is pivoted a head end cap 14 and a foot end cap 16. Shell 12, head end cap 14 and foot end cap 16 may preferably be fabricated of welded sheet metal panels. A gasket 18 is positioned atop upwardly facing horizontal surface 20 of casket shell flange 22 and is compressed by downwardly facing surface 24 of flange 26 of head end cap 14 when cap 14 is in its closed position. Gasket 18 is likewise compressed by the downwardly facing surface 28 of flange 30 of foot end cap 16 when cap 16 is in its closed position.

Foot end cap 16 includes a header wall 32. Along the lower edge of header wall 32 is a step 34 including an upwardly facing surface 36 atop which there is another gasket 38. Gasket 38 is compressed by step 34 and downwardly facing surface 40 of flange 26 when cap 14 is in its closed position of head end cap 14. Thus, casket 10 is what is known in the industry as a "sealable" casket, in that the continuous weld seams and gaskets of the casket 10 retain bodily fluids and gases in the casket 10 prior to burial and exclude rain water from the casket 10 after burial.

Referring still to FIG. 1, the sealable casket 10 includes a memorabilia compartment 50 formed preferably within the foot end cap 16. The memorabilia compartment 50 includes an access opening 52 and a removable cover 54 positioned over the access opening 52. A gasket 56 is disposed between the cover 54 and the cap 16 forming a seal therebetween. Cover plate 54 is preferably a face plate of a drawer 60 movably mounted in the cap 16. Gasket 56 is positioned against an outside surface 62 of header wall 32.

Figure 7:
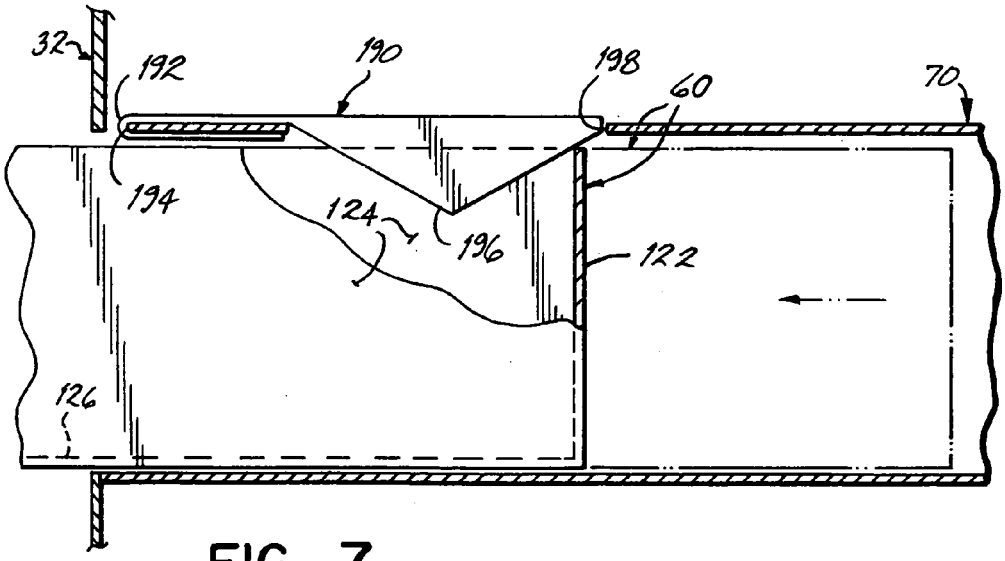
FIG. 7 is a cross sectional view, similar to FIG. 4, but illustrating the drawer stop preventing the drawer from being completely withdrawn from the channel.
Figure 4:
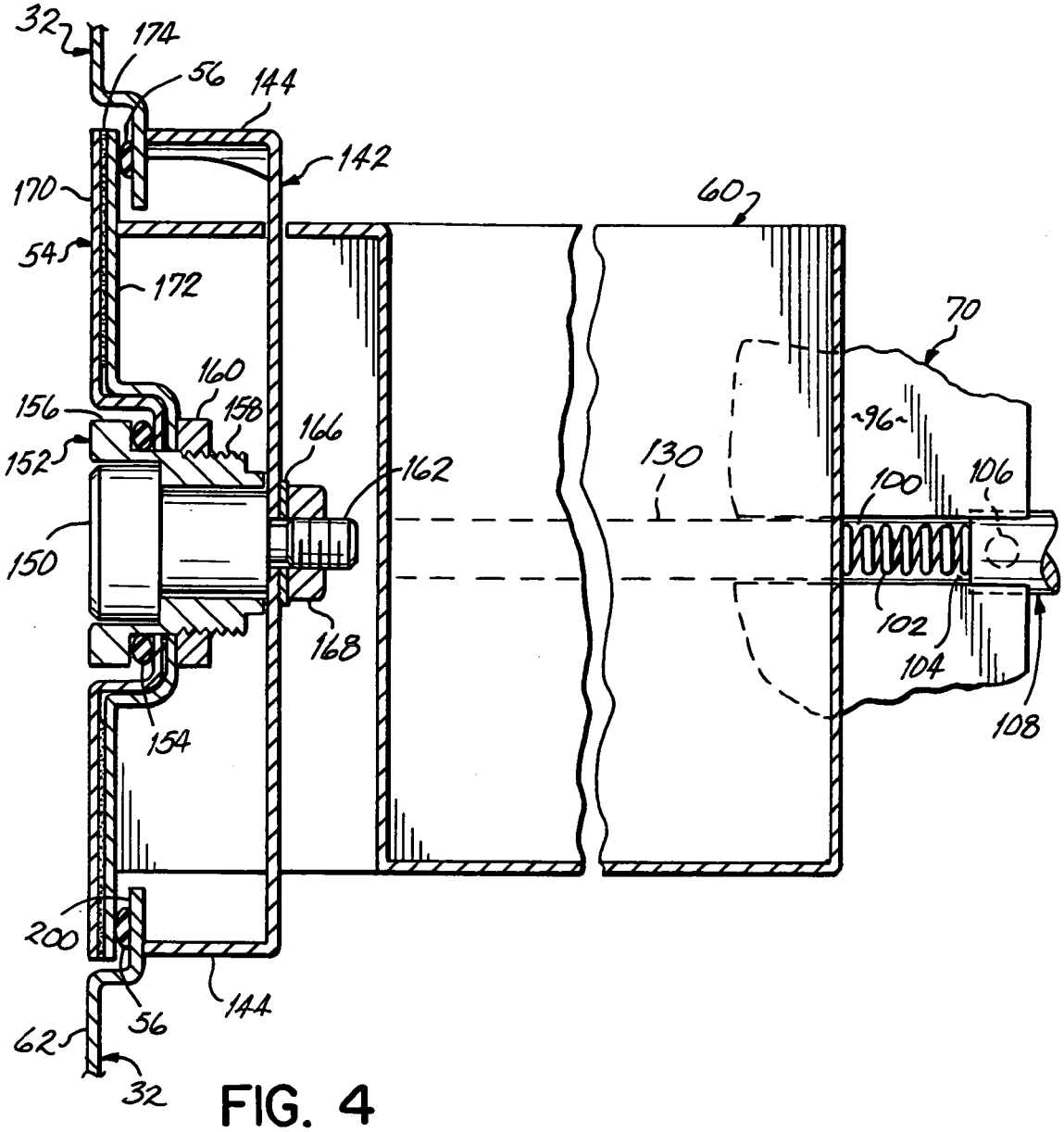
FIG. 4 is a cross sectional view similar to FIG. 3, but illustrating the drawer inserted completely into the cap.
Figure 5:
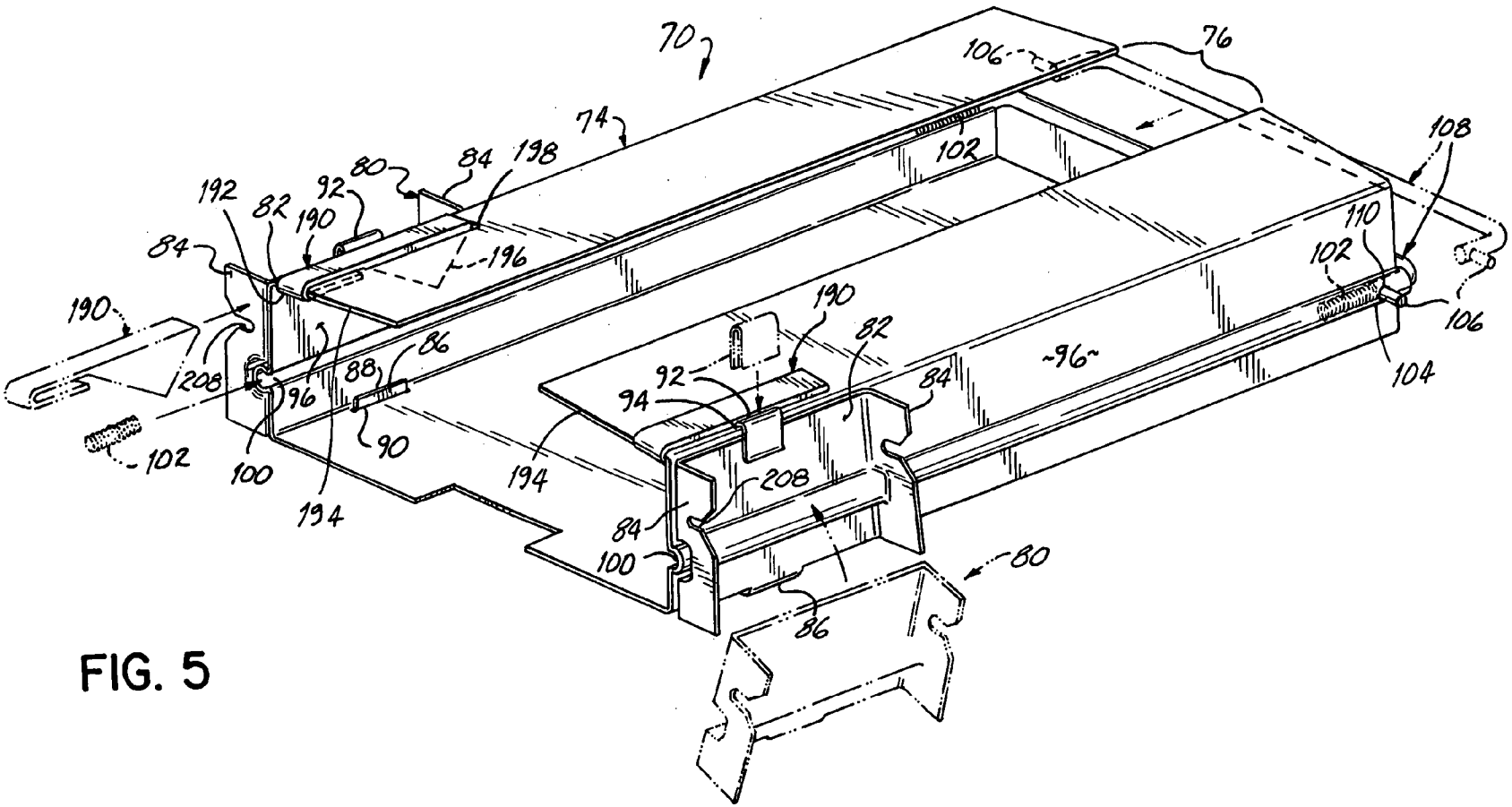
FIG. 5 is a perspective view of the drawer supporting channel.
Figure 6:
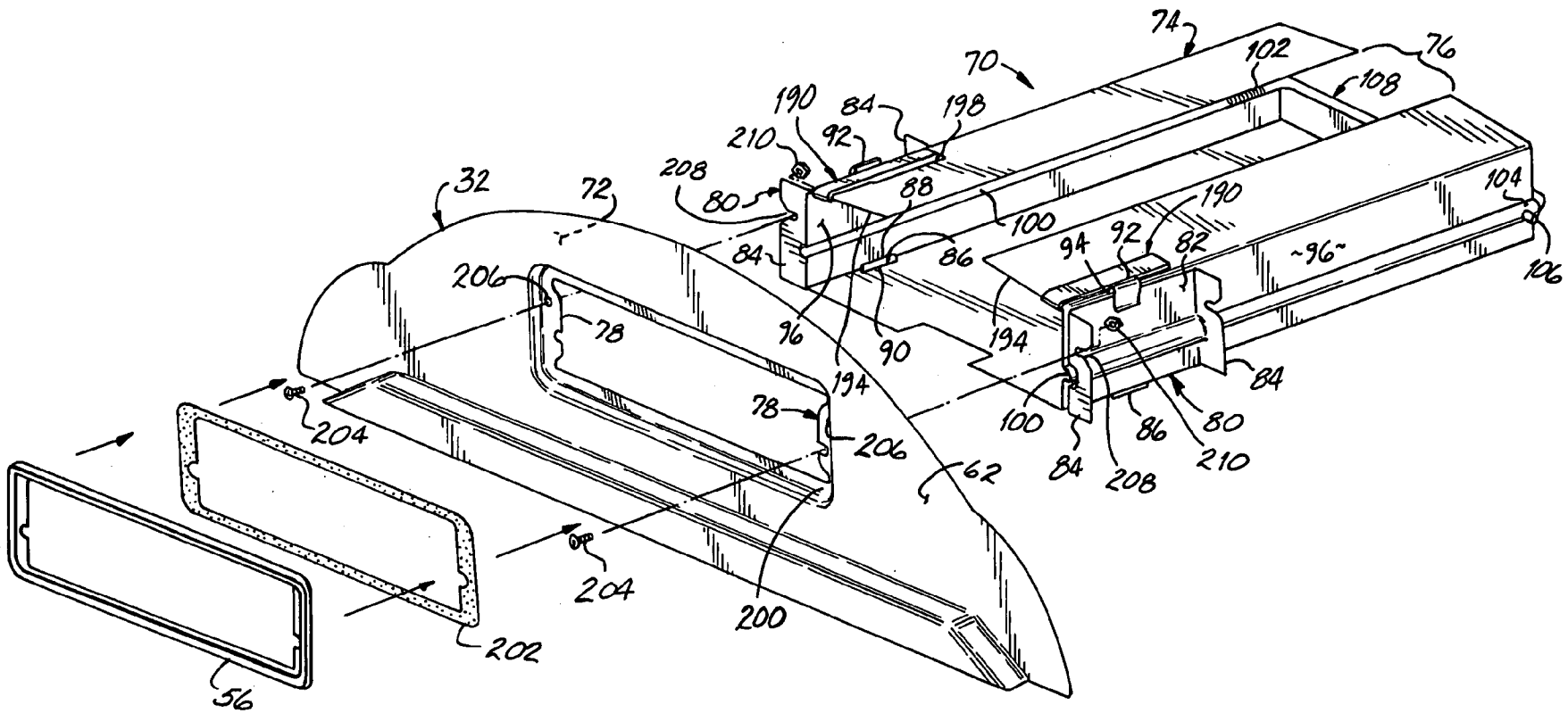
FIG. 6 is a perspective view of the drawer supporting channel as mounted from the inside surface of the header wall and the drawer gasket mounted around the access opening on the outside surface of the header wall.

Referring now to FIGS. 5-7, a drawer support 70 is mounted from an inside surface 72 of header wall 32. More particularly, drawer support 70 may preferably be an open-ended generally C-shaped channel 74, oriented horizontally, with the open portion 76 of the channel 74 facing upwardly. Channel 74 may be fabricated as a sheet metal stamping, or plastic or metal extrusion or the like. The channel 74 is mounted from the inside surface 72, and in particular from a pair of mounting tabs 78, via a pair of, for example, sheet metal or plastic, brackets 80, with one bracket 80 of the pair of brackets being located on each lateral side of the channel 74. Each bracket 80 preferably has a longer leg 82 and at least one shorter leg 84. The longer leg 82 is secured to the channel 74 and the shorter leg 84 is secured to the tabs 78 of the inside surface 72 of the header wall 32. Each bracket 80 is most preferably generally C-shaped having two shorter legs 84 so as to be reversible side-to-side of the channel 74 and end-to-end of each bracket 80. Thus, only one bracket 80 need be fabricated.

The longer leg 80 of each bracket 80 has an upwardly directed U-shaped tang 86 at a lower edge thereof. A free end 88 of the tang 86 is received in a slot 90 at a lower edge of the channel 74. A downwardly directed U-shaped clip 92 of, for example, sheet metal or plastic, has one leg received in a slot 94 at an upper edge of the channel 74 the other leg of which retains the longer leg 82 of the bracket 80 against a side 96 of the channel 74.

Drawer 60 is preferably spring biased toward an outward position. To that end, each lateral side 96 of the channel 74 includes a semicircular channel 100 formed therein. A compression spring 102 resides within each channel 100 and is retained at an inward end 104 thereof by a retaining pin 106. The pair of retaining pins 106 are interconnected by a pin connecting rod 108. The free ends of the pins 106 pass through holes 110 in the inward ends 104 of the semicircular channels 100 to retain the springs 102 therein.

Figure 2:
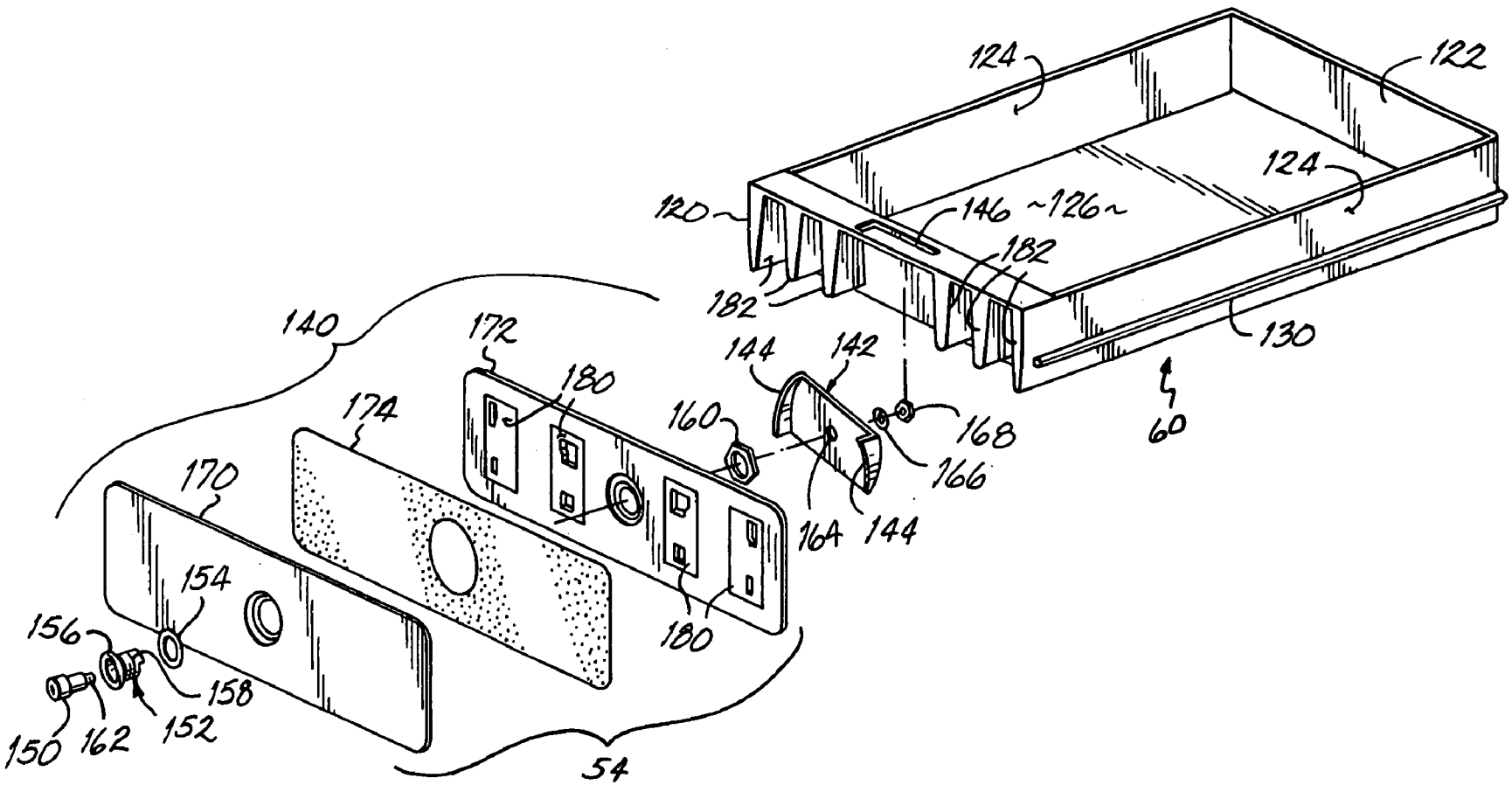
FIG. 2 is an exploded perspective view of the drawer portion of the invention.
Figure 3:
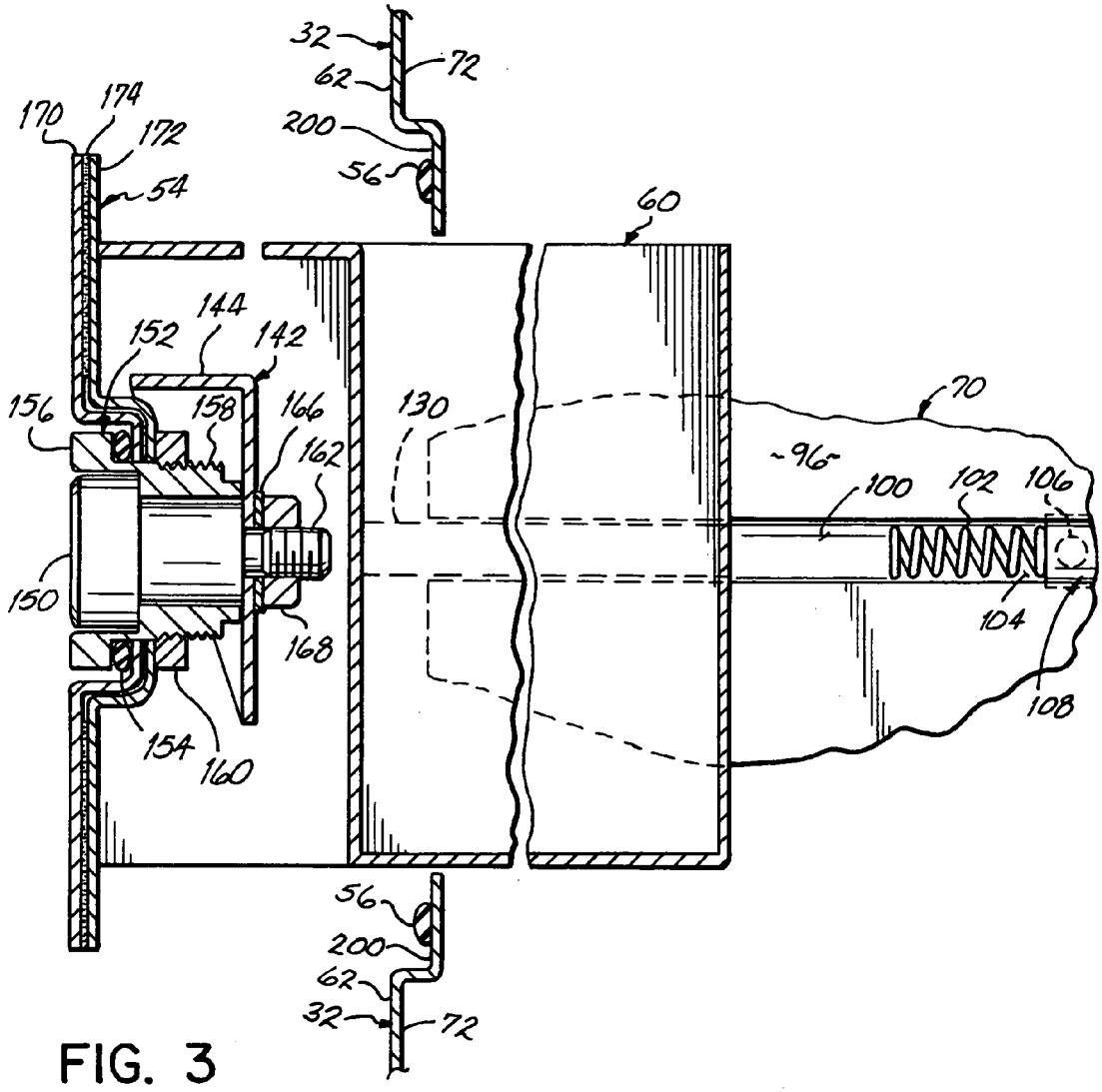
FIG. 3 is a cross sectional view taken along line 3-3 of FIG. 1 illustrating the drawer withdrawn from the cap.

Referring now back to FIG. 2, the drawer 60 includes a front 120, back 122, sides 124 and bottom 126. Drawer 60 may be fabricated of stamped and/or welded sheet metal or plastic. Decorative flocking or the like (not shown) may be installed on the bottom 126. Each of the sides 124 of the drawer 60 includes a rail 130 therealong. Each rail 130 rides in a respective one of the semicircular channels 110 in the channel 74. Thus, pushing the drawer 60 completely into the channel 74 causes the ends 132 of the rails 130 to compress the tension springs 102. In other words, drawer 60 is spring biased towards an outward position relative to the channel 74 and cap 16.

The drawer 60 preferably includes a latching mechanism 140 which latches the drawer 60 in an inward position compressing the gasket 56 between the face plate 54 and header wall 32. More particularly, latching mechanism 140 includes a cam 142 operable on or against the inside surface 72 of header wall 32 which when actuated draws the face plate 54 and the header wall 32 toward one another. The cam 142 includes cam surfaces 144 which cam against the inside surface 72 of head wall 32 and through "L" shaped slot 146 in upper surface of drawer front 120 during actuation thereof. The cam 142 is preferably actuated via a rotatable element mounted in the face plate 54, comprising a hex head insert 150 housed within a housing 152. A rubber washer 154 is disposed between a flange 156 of the housing 152 and face plate 54 to provide a seal therebetween. Housing 152 is threaded on its other end 158 and accepts a nut 160 threaded thereon and against an inside surface of the face plate 54. The hex head insert 150 is likewise threaded at 162. Cam 142 includes a through hole 164 through which threaded portion 162 of hex head insert 150 passes. A lock washer 166 and nut 168 secure cam 142 to the hex head insert 150.

Referring still to FIG. 2, face plate 54 may preferably include a decorative, for example bronze, face plate panel or placard 170 and a plastic face plate panel 172 between which is interposed double-sided tape 174 for securing the panels 170 and 172 together. Plastic panel 172 may preferably include locking tabs 180 which are slidably received between ribs 182 of front wall 120 of drawer 60 to install face plate 54 onto drawer 60.

Referring now to FIGS. 5, 6 and 7, channel 74 preferably includes a pair of stops 190 operable between the channel 74 and the drawer 60 to prevent the drawer 60 from being completely withdrawn from the channel 74 and hence cap 16. Each stop 190, which may be sheet metal or plastic, preferably comprises a U-shaped first end 192 which fits over a front upper edge 194 of the channel 74 and a wing 196 which extends generally perpendicularly from the U-shaped first end 192. The wing 196 projects through a slot 198 in an upper portion of the channel 74. Thus, once stops 190 are installed on channel 74, the wings 196 are positioned in the path of the rear wall 122 of drawer 60 (see FIG. 7), thereby preventing drawer 60 from being completely withdrawn from channel 74 and hence cap 16.

Referring back to FIG. 6, gasket 56 is installed within a recess 200 in header wall 32. Die cut adhesive tape 202 is used to secure the gasket 56 within the recess 200. Fasteners, for example pem studs or screws 204, pass through holes 206 in the tab portions 78 of header wall 32, pass through notches 208 in short legs 84 of brackets 80 and are secured on the rear sides thereof via nuts 210 or the like.

Those skilled in the art will readily recognize numerous adaptations and modifications which can be made to the present invention which will result in an improved sealable casket with memorabilia compartment, yet all of which will fall within the spirit and scope of the present invention as defined in the following claims. Accordingly, the invention is to be limited only by the scope of the following claims and their equivalents.

What is claimed is:

1. A casket comprising:

a casket shell;

a lid closeable upon said shell;

a drawer support mounted in said lid; and a drawer supported by said drawer support for movement between an inward position and an outward position;

said drawer support comprising an upwardly facing channel having a bottom wall and a pair of opposed side walls;

said drawer having a pair of opposed outwardly facing rails;

each said side wall of said drawer support channel having an inwardly facing channel formed therein, said inwardly facing channels receiving respective ones of said drawer opposed outwardly facing rails.

2. The casket of claim 1 wherein said casket shell, lid, drawer support, and drawer are fabricated of sheet metal.

3. The casket of claim 1 wherein said inwardly facing channels are semicircular in cross-section.

4. The casket of claim 1 further including a spring in each said inwardly facing channel, each said rail compressing a respective one of said springs when said drawer is in the inward position.

5. The casket of claim 1, said drawer further including a drawer front, one of said lid and said drawer front including a gasket compressed by said drawer front and said lid when said drawer is in the inward position.

6. The casket of claim 5 wherein said lid includes a header wall, said header wall including an opening therein for receiving said drawer, said gasket surrounding said header wall opening.

7. The casket of claim 1 further including a latching mechanism which latches said drawer in the inward position.

8. The casket of claim 7 wherein said latching mechanism includes a cam operable between said drawer and said lid which draws said drawer toward said lid.

9. The casket of claim 1, said upwardly facing drawer support channel further including a drawer stop blocking removal of said drawer from said channel.

10. The casket of claim 9 wherein said drawer stop includes a clip securable to an edge of said upwardly facing drawer support channel, said clip including a wing which projects into a path of said drawer and is operable against a rear wall of said drawer.

11. A casket comprising:

a casket shell;

a lid closeable upon said shell, said lid including a channel; and a drawer supported by said channel for movement between an inward position and an outward position;

said drawer further including a rail, said rail riding in said channel;

further including a spring in said channel, said rail compressing said spring when said drawer is in the inward position.

* * * * *